US008656897B2

(12) United States Patent
Haution et al.

(10) Patent No.: US 8,656,897 B2
(45) Date of Patent: Feb. 25, 2014

(54) DEVICE FOR GENERATING RADIOFREQUENCY PLASMA

(75) Inventors: Sebastien Haution, Longjumeau (FR); Thierry Prunier, L'hay les Roses (FR); Frederic Roque, Montgeron (FR); Yorick Duchaussoy, Darnetal (FR); Franck Deloraine, Fontenay aux Roses (FR)

(73) Assignee: Renault S.A.S., Boulogne-Billancourt (FR)

( * ) Notice: Subject to any disclaimer, the term of this patent is extended or adjusted under 35 U.S.C. 154(b) by 764 days.

(21) Appl. No.: 12/672,286

(22) PCT Filed: Jul. 30, 2008

(86) PCT No.: PCT/FR2008/051433

§ 371 (c)(1),
(2), (4) Date: Nov. 23, 2010

(87) PCT Pub. No.: WO2009/024713

PCT Pub. Date: Feb. 26, 2009

(65) Prior Publication Data

US 2011/0163673 A1 Jul. 7, 2011

(30) Foreign Application Priority Data

Aug. 8, 2007 (FR) ..... 07 05773

(51) Int. Cl.
*F02B 31/00* (2006.01)
*F02P 3/01* (2006.01)

(52) U.S. Cl.
USPC ..... 123/608; 123/309

(58) Field of Classification Search
USPC ..... 315/111.21, 111.31, 209 T, 209 M; 123/309, 329.1, 606, 608, 636, 179.5
See application file for complete search history.

(56) References Cited

U.S. PATENT DOCUMENTS

| | | | | |
|---|---|---|---|---|
| 4,369,758 | A | 1/1983 | Endo | |
| 5,179,928 | A | 1/1993 | Cour et al. | |
| 5,775,298 | A * | 7/1998 | Haller | 123/406.27 |
| 5,815,047 | A * | 9/1998 | Sorensen et al. | 333/17.3 |
| 6,112,730 | A * | 9/2000 | Marrs et al. | 123/606 |
| 6,135,099 | A * | 10/2000 | Marrs et al. | 123/606 |
| 6,424,232 | B1 * | 7/2002 | Mavretic et al. | 333/17.3 |
| 7,210,442 | B2 * | 5/2007 | Toyoshima | 123/179.3 |

(Continued)

FOREIGN PATENT DOCUMENTS

| | | |
|---|---|---|
| DE | 10 2005 036 968 | 2/2007 |
| EP | 1 515 594 | 3/2005 |

(Continued)

*Primary Examiner* — Minh D A
(74) *Attorney, Agent, or Firm* — Oblon, Spivak, McClelland, Maier & Neustadt, L.L.P.

(57) ABSTRACT

A device for generating a radiofrequency plasma, that includes a voltage generator, and at least one ignition assembly that includes an ignition plug and a switch provided between a supply terminal of the plug and an output of the generator adapted for electrically connecting the output of the voltage generator to the plug upon reception of a control signal, and an electronic control unit generating the control signal. The electronic control unit measures values representative of evolution in time of the output voltage of the generator. The device further includes a mechanism varying the voltage and/or the frequency of the electric current applied to the supply terminal of the plug based on measured values. The evolution of the generator output voltage is representative of the condition of the plug (new or used).

10 Claims, 1 Drawing Sheet

(56) References Cited

U.S. PATENT DOCUMENTS

| | | | | |
|---|---|---|---|---|
| 2004/0237950 | A1* | 12/2004 | Metzelard | 123/625 |
| 2007/0240693 | A1* | 10/2007 | Lykowski | 123/620 |
| 2009/0309499 | A1* | 12/2009 | Agneray et al. | 315/111.21 |

FOREIGN PATENT DOCUMENTS

| | | |
|---|---|---|
| FR | 2 649 759 | 1/1991 |
| FR | 2 895 169 | 6/2007 |
| GB | 2 085 076 | 4/1982 |

* cited by examiner

DEVICE FOR GENERATING RADIOFREQUENCY PLASMA

BACKGROUND OF THE INVENTION

The present invention relates, generally, to the field of radiofrequency plasma-generating devices comprising spark plugs for initiating the combustion of fuel in a combustion chamber of an internal combustion engine.

SUMMARY OF THE INVENTION

More particularly, the invention relates to a device for generating radiofrequency plasma comprising:

- a voltage generator; and
- at least one ignition assembly, said ignition assembly comprising:
  - a spark plug suitable for generating a spark when a voltage level is applied to this plug; and
  - a switch positioned between a power supply terminal of the plug and an output of the voltage generator, the switch being suitable for electrically and selectively connecting the output of the voltage generator to said power supply terminal of the plug upon receipt of a control signal applied to a control terminal of said switch;

the device further comprising an electronic control unit electrically connected to said control terminal of said switch and suitable for generating said control signal.

The plugs of the radiofrequency plasma-generating devices are suitable for generating sparks or plasma in order to make it possible to initiate a combustion. The control over time of the quality of the sparks produced by a plug is therefore critical.

In this context, the aim of the present invention is to propose a device for generating radiofrequency plasma that makes it possible to control the quality of the sparks produced by a radiofrequency plug.

To this end, the inventive device for generating radio-frequency plasma, also conforming to the generic definition given of it by the previously defined preamble, is mainly characterized in that the electronic control unit includes means of measuring values representative of the trend over time of the output voltage of the voltage generator, and in that the device includes means of varying the voltage and/or the frequency of the electrical current applied to said power supply terminal of the plug according to values measured by said measuring means.

This novel device is particularly advantageous in that it makes it possible:

- on the one hand, to measure parameters associated with the trend of output voltage of the generator, this trend being representative of the condition of the plug powered by the generator; and
- on the other hand, to vary the voltage and/or the frequency of the electrical power supply current of this plug, bearing in mind that this voltage and this frequency are parameters determining the quality of the spark generated.

The inventive device therefore makes it possible to alter the power supply voltage of a plug according to voltage trend measurements that are representative of the state of wear or of clogging of the plug or, for example, of failed sparks (split, too small, etc.).

In practice, as shown in FIG. 2 which will be described later, the power supply voltage of a worn or clogged plug tends to decrease less rapidly than the power supply voltage of a new plug. Thanks to the inventive device, it is therefore possible to envisage varying the voltage generated by the generator according to the observed condition of the plug and in particular its capacity to dissipate electrical energy to produce sparks. For example, it is possible to increase the nominal voltage setpoint that the generator must supply to a given plug.

It is, for example, possible to have the electronic control unit include means of comparing measured values with theoretical values prestored in a memory of the device.

This embodiment makes it possible to check the condition of a plug according to prestored values that have been measured by measurements on a test bench for typical plugs.

It is, for example, possible to have the electronic control unit be electrically connected to said voltage generator and the voltage generator be suitable for varying the output voltage of the generator according to a control signal for the generator delivered by the electronic control unit.

This embodiment makes it possible for the control unit that receives the generator output voltage measurements to process these measurements in order to generate a control signal for the generator in order for the latter to ultimately adapt its output voltage, thus improving the quality of the spark produced by the plug.

It is, for example, possible to have the electronic control unit be electrically connected to said voltage generator and the voltage generator be suitable for varying the frequency of the electrical current generated at the output of the generator according to a control signal for the generator delivered by the electronic control unit.

This embodiment makes it possible for the electronic control unit that receives the generator output voltage measurements to process these measurements to generate a control signal for the generator such that the generator ultimately adapts its output frequency. This embodiment improves the quality of the spark produced by the plug by adapting the power supply frequency.

It is, for example, possible to have said switch be suitable for varying the frequency of the electrical current applied to said power supply terminal of the plug according to said control signal generated by said electronic control unit.

In this embodiment, the control signal for the switch is used to vary the frequency of the power supply current for the plug.

It is, for example, possible to have the device for generating radiofrequency plasma include a number of ignition assemblies of the predefined type, each switch of each ignition assembly being connected to said voltage generator and to said control unit.

This embodiment makes it possible to control a number of spark plugs according to the same principle of measuring the trend over time of the output voltage of the generator when one of the plugs is powered then, according to this measurement, to assess the state of wear of this plug in order, if necessary, to adjust its power supply voltage.

It is, for example, possible to have each ignition assembly receive a control signal specific to this ignition assembly.

This characteristic makes it possible to independently control each switch of each ignition assembly and consequently makes it possible to control the power supply delay for each plug and, if necessary, the frequency of this power supply when the switch is suitable for varying the frequency according to the specific signal.

In a preferable embodiment linked with the preceding embodiment, each switch is made to be suitable for defining the frequency of the electrical current powering the plug to which it is connected according to the specific control signal that it receives.

Preferably, each switch is suitable for defining the frequency of the electrical current powering the plug to which it is connected so that the frequency powering this plug is equal to the frequency of the specific control signal that it receives.

It is, for example, possible to have said means of varying the voltage and/or the frequency of the electrical current be suitable for varying, according to said values measured by said measuring means, each of the voltages and/or frequencies of the electrical currents applied to the power supply terminals of each of the plugs.

The invention also relates to a method of controlling the inventive plasma-generating device, mainly characterized in that an electrical power supply current is applied to a power supply terminal of a spark plug, then values representative of the trend over time of the output voltage of the voltage generator are measured and these measured values are compared with prestored theoretical values and the power supply voltage applied to the terminal of the plug is varied according to the difference observed between these measured values with prestored theoretical values.

By observing the difference between the measured values representative of the trend over time of the output voltage of the voltage generator and prestored theoretical values it is possible to determine the condition of a plug and in particular its energy transfer rate. It should be noted that the theoretical value can be a parameter such as an energy transfer rate that is a parameter evaluating the speed of energy transfer from a new or model plug.

Having determined the condition of the plug, the power supply voltage of this plug is varied accordingly so as to improve the operation of this plug. In this case, the nominal voltage setpoint of the generator can be increased as the plug becomes more worn/clogged, in other words as the energy transfer rate of this plug decreases.

In other words, depending on the observed state of the plug, it is possible to decide to apply to this plug a power supply voltage that is different from that applied in the first and second measurements.

BRIEF DESCRIPTION OF THE DRAWINGS

Other characteristics and benefits of the invention will become clearly apparent from the description that is given thereof hereinbelow, in an indicative and by no means limiting way, with reference to the appended drawings, in which.

DETAILED DESCRIPTION OF THE INVENTION

Figure 1:
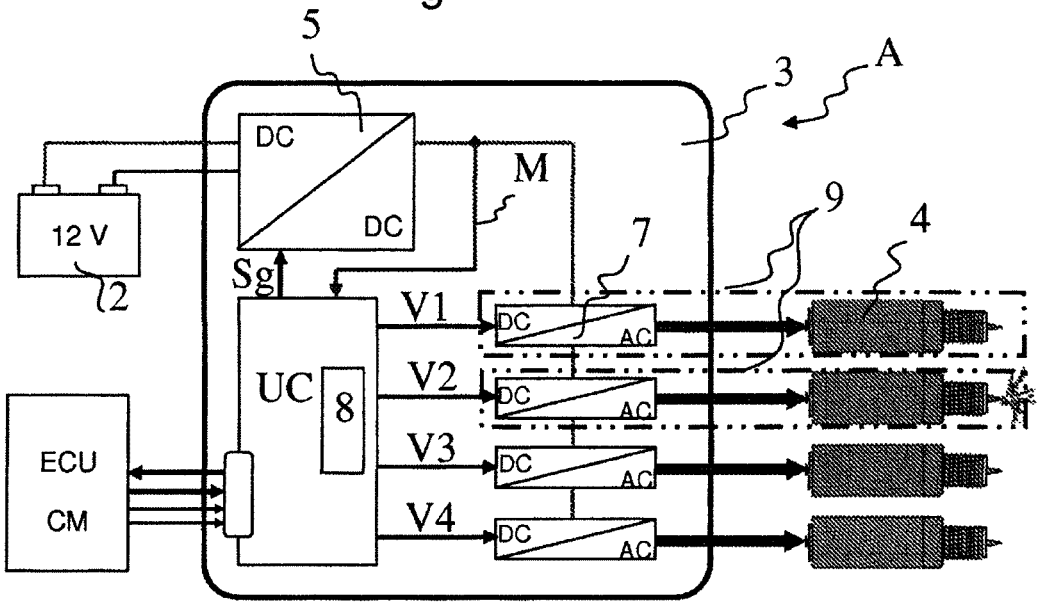
FIG. 1 represents the inventive plasma-generating device.

As stated previously, the invention relates to a device for generating radiofrequency plasma A comprising:

- a voltage generator 5; and
- a number of ignition assemblies 9 that are substantially identical to each other.

The voltage generator 5 is supplied with DC current by a battery 2 and generates a current of variable voltage available at the output of the generator.

An ignition assembly 9 comprises a radiofrequency plug and a switch 7 selectively connecting the radio-frequency plug 4 to the output of the voltage generator 5 so that this plug 4 is selectively powered.

The switch 7 includes a control terminal for the switch that is suitable for receiving a control signal for the switch V1 (or V2, V3, V4 depending on the ignition assembly concerned) and, according to this signal, electrically connecting or not connecting the generator 5 to a terminal of the plug 4. When the plug 4 receives a sufficient power supply voltage from the generator 5, the latter generates sparks forming a plasma and the voltage at the output of the generator 5 decreases over time throughout the spark-generation period.

The inventive device A also includes an electronic control unit UC that is connected to an engine control unit ECU CM with which it communicates in order to manage the ignition device A according to the requirements of the engine provided with this inventive ignition device.

The electronic control unit UC is also connected to the voltage generator 5 so as to transmit control signals for the generator Sg.

These control signals Sg for the generator are interpreted by the generator which varies the generator output voltage according to the control signals Sg.

In this case, the control signal of the voltage generator Sg is made to depend on a comparison of at least one of the measured values (which are values representative of the trend over time of the output voltage of the generator) with at least one setpoint value prestored in a memory of the device. This comparison between a real measured value and a theoretical value makes it possible to determine the state of wear of the plug.

Thus, the output voltage of the generator varies according to the measured state of wear of the plug 4 that has to be powered or that is powered by the generator.

The electronic control unit UC is also connected to the output of the voltage generator 5 by a measurement circuit M taking measurements of the electrical voltage at the output of the generator 5.

The electronic control unit further includes a memory storing theoretical values representative of the energy transfer rate of a plug at different stages of its life.

In a particular embodiment of the invention, the electronic control unit UC also includes a frequency generator, in this case a fixed frequency generator, that generates the different control signals V1 (V2, V3, V4) applied to the terminals of the switches 7 to which this frequency generator 8 is connected. This frequency is chosen to be fixed to correspond to a resonance frequency of the plugs so as to generate a large-volume plasma, and in this case only the power supply voltage is variable.

It should be noted that an energy transfer rate is an example of a value representative of the trend over time of the output voltage of the generator 5 that is connected to the plug transferring the energy produced by the generator.

The electronic control unit UC therefore controls the generation of the sparks by transmitting a switch control signal V1 to the switch 7 that connects a plug terminal to the output 7 of the generator 5.

Upon receipt of this signal V1 the switch connects the power supply terminal of the plug 4 to the output of the generator 5 which produces an output voltage of a value that is fixed by the generator control signal Sg.

The plug 4 then generates sparks and discharges the energy at a certain speed which depends on the state of the plug 4.

It should be noted that the operation of a radio-frequency plug 4 depends on:

- the resonance frequency of the plug 4 which varies according to the state of wear of this plug,
- the ignition start setpoint voltage set by calibration, that is to say, the output voltage delivered by the generator 5;
- the spark duration set by calibration.

Figure 2:
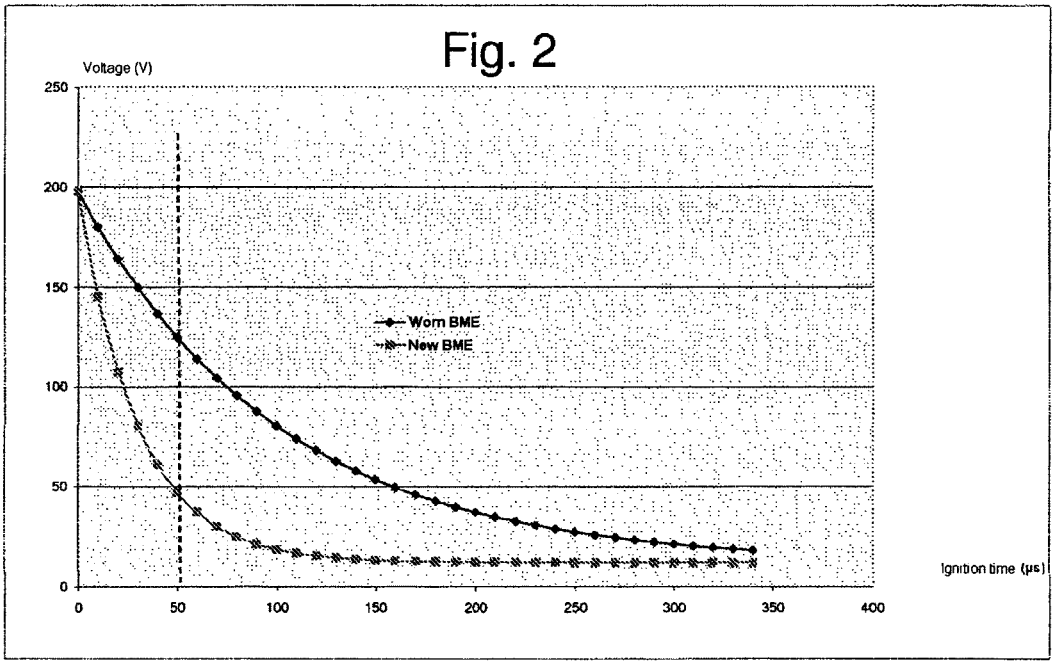
FIG. 2 represents two trend curves of the output voltage of the voltage generator as a function of time for a new plug and for a worn plug.

As can be seen in FIG. 2 where there are two curves of voltage degradation at the generator output, one corresponding to the operation of a "worn BME", that is to say, a worn or clogged plug, and the other corresponding to the "new BME" operation, that is to say, to a new plug.

It can be seen that the voltage degradation speed is greater for the new plug compared to the worn plug.

The electronic control unit UC receives voltage measurements M from means of measuring values representative of the trend of the voltage at the output of the generator 5.

At least two measurements are taken to determine the speed of voltage degradation at the generator output and, more particularly, the energy transfer rate of the powered plug.

More specifically, the electronic control unit UC acquires the voltage at the output of the voltage step-up device 5 at the start of conduction of the control stage 7, that is to say at the moment when the signal V1 is transmitted to the switch 7. This acquisition of a value Vstart_all(x) representative of the output voltage of the generator is performed when the plug starts to be powered by the generator. Vstart_all(x) is stored in the memory of the control unit.

When the switch or control stage 7 stops connecting the plug 4 to the output of the generator 5, after a time equal to the spark duration, the computation unit 6 acquires the output voltage from the voltage step-up device 5.

The value Vend_all(x) representative of the generator output voltage a little before the power supply to the plug is stopped is acquired and stored in the memory of the electronic control unit UC.

It should be noted that these start and end moments can easily be calculated since they are determined by the control unit itself which controls the switch 7 via the signal V1.

Given that there are a number of ignition assemblies 9, "x" represents the order numbers of the multi-spark plug of cylinders No. 1, 2, 3 and 4 of a four-cylinder engine.

After having stored, for each plug of order "x", the voltage values Vstart_all(x) and Vend_all(x), there is then calculated for each plug a value representative of the trend over time of the generator output voltage, that is to say, representative of the power supply voltage of each plug of order "x".

In this case, this representative value is the $$\text{energy_transfer_rate}(x) = \frac{\text{Vstart_all}(x)^2 - \text{Vend_all}(x)^2}{\text{Vstart_all}(x)^2},$$

which is an adimensional value.

This value representative of the state of wear of a plug of order "x" is compared with theoretical energy transfer rate values to generate a correction value making it possible to generate a control signal for the generator Sg setting the voltage setpoint at the output of the generator at the moment of start of power supply for a given plug "x".

The correction value can, in this case, be obtained by a linear interpolation through a table that is a function of the "energy transfer rate". Such a table establishes a correlation between a measured "energy transfer rate" and a theoretical "energy transfer rate" which has a corresponding given correction value used to define a nominal output voltage setpoint of the generator.

For example, it is possible to add the correction factor obtained via the data table to the nominal voltage setpoint for a new reference component in order to determine the new nominal voltage setpoint at the output of the generator, this new setpoint taking into account the wear of the plug.

The invention claimed is:

1. A device for generating radiofrequency plasma comprising:

a voltage generator configured to output voltage at a voltage setpoint;

at least one ignition assembly, the ignition assembly comprising:

a spark plug that generates a spark between two electrodes of the plug when a voltage level is applied to the plug; and a switch positioned between a power supply terminal of the plug and an output of the voltage generator, the switch configured to electrically and selectively connect the output of the voltage generator to the power supply terminal of the plug upon receipt of a control signal applied to a control terminal of the switch;

an electronic control unit electrically connected to the control terminal of the switch and configured to generate the control signal, the electronic control unit including measuring means for measuring at least two values representative of a trend over time of the output voltage from the voltage generator, including a first measurement taken at a start of conduction of the control signal and a second measurement taken before an end of conduction of the control signal; and means for varying the voltage and/or the frequency of the electrical current applied to the power supply terminal of the plug according to a new nominal voltage setpoint at the output of the voltage generator based on the values measured by the measuring means, wherein the electronic control unit is configured to calculate an energy transfer rate according to the following equation:

$$\text{energy_transfer_rate}(x) = \frac{\text{Vstart_all}(x)^2 - \text{Vend_all}(x)^2}{\text{Vstart_all}(x)^2},$$

with Vstart_all(x) being the first measurement and Vend_all(x) being the second measurement, and the energy transfer rate calculated by the electronic control unit is compared with theoretical energy transfer rate values to generate a correction value, and the correction value is added to the energy transfer rate calculated by the electronic control unit to determine the new nominal voltage setpoint at the output of the voltage generator.

2. The device for generating radiofrequency plasma as claimed in claim 1, wherein the electronic control unit includes means for comparing the energy transfer rate calculated by the electronic control unit with the theoretical energy transfer rate values prestored in a memory of the device.

3. The device for generating radiofrequency plasma as claimed in claim 1, wherein the electronic control unit is electrically connected to the voltage generator, and the voltage generator is configured to vary the output voltage of the generator according to a control signal for the generator delivered by the electronic control unit.

4. The device for generating radiofrequency plasma as claimed in claim 1, wherein the electronic control unit is electrically connected to the voltage generator, and the voltage generator is configured to vary the frequency of the electrical current generated at the output of the generator according to a control signal for the generator delivered by the electronic control unit.

5. The device for generating radiofrequency plasma as claimed in claim 1, wherein the switch is configured to vary the frequency of the electrical current applied to the power supply terminal of the plug according to a control signal generated by the electronic control unit.

6. The device for generating radiofrequency plasma as claimed in claim 1, further comprising a plurality of ignition assemblies of predefined type, each switch of each ignition assembly being connected to the voltage generator and to the control unit.

7. The device for generating radiofrequency plasma as claimed in claim 6, wherein each ignition assembly receives a control signal specific to the ignition assembly.

8. The device for generating radiofrequency plasma as claimed in claim 6, wherein the means for varying the voltage and/or the frequency of the electrical current vary, according to the values measured by the measuring means, each of the voltages and/or frequencies of the electrical currents applied to the power supply terminals of each of the plugs.

9. A method for generating radiofrequency plasma, the method comprising:

outputting voltage from an output of a voltage generator at a voltage setpoint;

generating a spark between two electrodes of a spark plug when a voltage level of the output voltage from the voltage generator is applied to the plug;

electrically and selectively connecting, with a switch positioned between a power supply terminal of the plug and the output of the voltage generator, the output of the voltage generator to the power supply terminal of the plug upon receipt of a control signal applied to a control terminal of the switch;

generating, with an electronic control unit electrically connected to the control terminal of the switch, the control signal;

measuring, with the electronic control unit, values representative of a trend over time of the output voltage from the voltage generator, the measuring including taking a first measurement at a start of conduction of the control signal and taking a second measurement before an end of conduction of the control signal; and varying the voltage and/or the frequency of the electrical current applied to the power supply terminal of the plug according to a new nominal voltage setpoint at the output of the voltage generator based on the values measured by the measuring step, wherein the electronic control unit is configured to calculate an energy transfer rate according to the following equation:

$$\text{energy_transfer_rate}(x) = \frac{\text{Vstart_all}(x)^2 - \text{Vend_all}(x)^2}{\text{Vstart_all}(x)^2},$$

with Vstart_all(x) being the first measurement and Vend_all(x) being the second measurement, and the energy transfer rate calculated by the electronic control unit is compared with theoretical energy transfer rate values to generate a correction value, and the correction value is added to the energy transfer rate calculated by the electronic control unit to determine the new nominal voltage setpoint at the output of the voltage generator.

10. The device for generating radiofrequency plasma as claimed in claim 1, wherein the electronic control unit is directly connected to the control terminal of the switch.

* * * * *